US007445422B2

(12) United States Patent
Hablanian

(10) Patent No.: US 7,445,422 B2
(45) Date of Patent: Nov. 4, 2008

(54) HYBRID TURBOMOLECULAR VACUUM PUMPS

(75) Inventor: Marsbed Hablanian, Wellesley, MA (US)

(73) Assignee: Varian, Inc., Palo Alto, CA (US)

( * ) Notice: Subject to any disclaimer, the term of this patent is extended or adjusted under 35 U.S.C. 154(b) by 562 days.

(21) Appl. No.: 11/127,851

(22) Filed: May 12, 2005

(65) Prior Publication Data

US 2006/0257249 A1 Nov. 16, 2006

(51) Int. Cl.
*F04D 13/12* (2006.01)

(52) U.S. Cl. ..... 415/55.1; 415/55.6; 415/90; 415/143

(58) Field of Classification Search ..... 415/90, 415/143, 55.1–55.7; 417/423.4
See application file for complete search history.

(56) References Cited

U.S. PATENT DOCUMENTS 5,074,747 A 12/1991 Ikegami et al.
5,238,362 A 8/1993 Casaro et al.
5,358,373 A 10/1994 Hablanian
5,536,148 A * 7/1996 Nishiuchi et al. ..... 415/90
5,664,935 A * 9/1997 Nishiuchi et al. ..... 415/90
5,848,873 A 12/1998 Schofield
6,135,709 A 10/2000 Stones
6,607,351 B1 8/2003 Hablanian

* cited by examiner

*Primary Examiner*—Igor Kershteyn
(74) *Attorney, Agent, or Firm*—Bella Fishman

(57) ABSTRACT

A hybrid turbomolecular vacuum pump includes a housing having an inlet port and an exhaust port, one or more axial flow stages located within the housing, each of the axial flow stages including a stator and an impeller, each having inclined blades, at least one additional vacuum pumping stage which is not an axial flow stage, the additional vacuum pumping stage being located within the housing and including a stator and an impeller, and a motor to rotate the impellers such that gas is pumped from the inlet port to the exhaust port. The vacuum pump does not include a molecular drag stage having a rotating cylindrical drum or a rotating disk with a flat pumping surface. The additional vacuum pumping stage may be a modified molecular drag stage, wherein the impeller includes a disk having a roughened or grooved pumping surface, and/or a regenerative stage.

15 Claims, 7 Drawing Sheets

HYBRID TURBOMOLECULAR VACUUM PUMPS

FIELD OF THE INVENTION

This invention relates to hybrid turbomolecular vacuum pumps and, more particularly, to hybrid turbomolecular vacuum pumps which include axial flow stages and one or more additional stages. The vacuum pump does not include a molecular drag stage having a rotating cylindrical drum or a rotating disk with a flat pumping surface.

BACKGROUND OF THE INVENTION

Conventional turbomolecular vacuum pumps include a housing having an inlet port, an interior chamber containing a plurality of axial pumping stages, and an exhaust port. The exhaust port is typically attached to a roughing vacuum pump. Each axial pumping stage includes a stator having inclined blades and a rotor having inclined blades. The rotor and stator blades are inclined in opposite directions. The rotor blades are rotated at high speed by a motor to pump gas between the inlet port and the exhaust port. A typical turbomolecular vacuum pump may include nine to twelve axial pumping stages.

Variations of the conventional turbomolecular vacuum pump, often referred to as hybrid turbomolecular vacuum pumps, have been disclosed in the prior art. In one prior art configuration, one or more of the axial pumping stages are replaced with molecular drag stages which form a molecular drag compressor. This configuration is disclosed in U.S. Pat. No. 5,238,362, issued Aug. 24, 1993 and assigned to Varian Inc. A hybrid vacuum pump including an axial turbomolecular compressor and a molecular drag compressor in a common housing is sold by Varian, Inc. Molecular drag stages and regenerative stages for hybrid vacuum pumps are disclosed in the U.S. Pat. No. 5,358,373, issued Oct. 25, 1994 and assigned to Varian Inc. A gradual change in the design of the stators of the axial pumping stages is also disclosed in the U.S. Pat. No. 5,358,373. Other hybrid vacuum pumps are disclosed in the U.S. Pat. No. 5,074,747, issued Dec. 24, 1991, the U.S. Pat. No. 5,848,873, issued Dec. 15, 1998; and the U.S. Pat. No. 6,135,709, issued Oct. 24, 2000. The disclosed hybrid vacuum pumps use existing impeller types and switch abruptly from one impeller type to another.

Conventional molecular drag stages include a rotating disk, or impeller, and a stator. A pumping surface of the rotating disk is flat and smooth. The stator defines a tangential flow channel and an inlet and an outlet for the tangential flow channel. A stationary baffle, often called a stripper, disposed in the tangential flow channel separates the inlet and the outlet. As is known in the art, the momentum of the rotating disk is transferred to gas molecules within the tangential flow channel, thereby directing the molecules toward the outlet. Molecular drag stages were developed for molecular flow conditions.

Another type of molecular drag stage includes a cylindrical drum that rotates within a housing having a cylindrical interior wall in close proximity to the rotating drum. The outer surface of the cylindrical drum or the wall is provided with a helical groove. As the drum rotates, gas is pumped through the groove by molecular drag.

U.S. Pat. No. 6,607,351, issued Aug. 19, 2003 and assigned to Varian Inc., discloses hybrid turbomolecular vacuum pumps wherein the impellers of successive stages are configured with a surface topography for efficient operation at progressively higher pressures. The surface topography may include a roughened or a grooved pumping surface.

A regenerative vacuum pumping stage includes a regenerative impeller which operates within a stator that defines a tangential flow channel. The regenerative impeller includes a rotating disk having spaced-apart radial ribs at or near its outer periphery. Regenerative vacuum pumping stages were developed for viscous flow conditions.

All of the known prior art hybrid turbomolecular vacuum pumps have included one or more molecular drag stages wherein the impeller is a rotating disk having a flat surface or is a cylindrical drum. These stages require rotor-stator gaps of about five to eight thousandths of an inch to achieve a desired compression ratio. Maintaining such small gaps while minimizing the risk of contact between the rotor and the stator in several stages requires extremely tight tolerances and results in high manufacturing cost.

Accordingly, there is a need for improved hybrid turbomolecular vacuum pumps.

SUMMARY OF THE INVENTION

According to a first aspect of the invention, a vacuum pump is provided. The vacuum pump comprises a housing having an inlet port and an exhaust port, one or more axial flow stages located within the housing, each of the axial flow stages including a stator and an impeller, each having inclined blades, at least one additional vacuum pumping stage which is not an axial flow stage, the additional vacuum pumping stage being located within the housing and including a stator and an impeller, and a motor to rotate the impellers such that gas is pumped from the inlet port to the exhaust port. The vacuum pump does not include a molecular drag stage having a rotating cylindrical drum or a rotating disk with a flat pumping surface.

The vacuum pump includes one or more axial flow stages and one or more additional stages. The additional stages may include modified molecular drag stages, regenerative stages, or both. The impeller of the modified molecular drag stage includes a disk having a roughened or grooved pumping surface. The total number of stages in the vacuum pump may be varied within the scope of the invention. Furthermore, the number of axial flow stages and the number of additional vacuum pumping stages may be varied within the scope of the invention.

According to a second aspect of the invention, a vacuum pump is provided. The vacuum pump comprises a housing having an inlet port and an exhaust port, one or more axial flow stages located within the housing, each of the axial flow stages including a stator and an impeller, each having inclined blades, at least one modified molecular drag stage located within the housing and including a stator and an impeller, and a motor to rotate the impeller such that gas is pumped from the inlet port to the exhaust port. The vacuum pump does not include a molecular drag stage having a rotating cylindrical drum or a rotating disk with flat pumping surface.

According to a third aspect of the invention, a vacuum pump is provided. The vacuum pump comprises a housing having an inlet port and an exhaust port, one or more axial flow stages located within the housing, each of the axial flow stages including a stator and an impeller, each having inclined blades, at least one regenerative stage located within the housing and including a stator and an impeller, and a motor to rotate the impeller such that gas is pumped from the inlet port to the exhaust port. The vacuum pump does not include a molecular drag stage having a rotating cylindrical drum or a rotating disk with a flat pumping surface.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
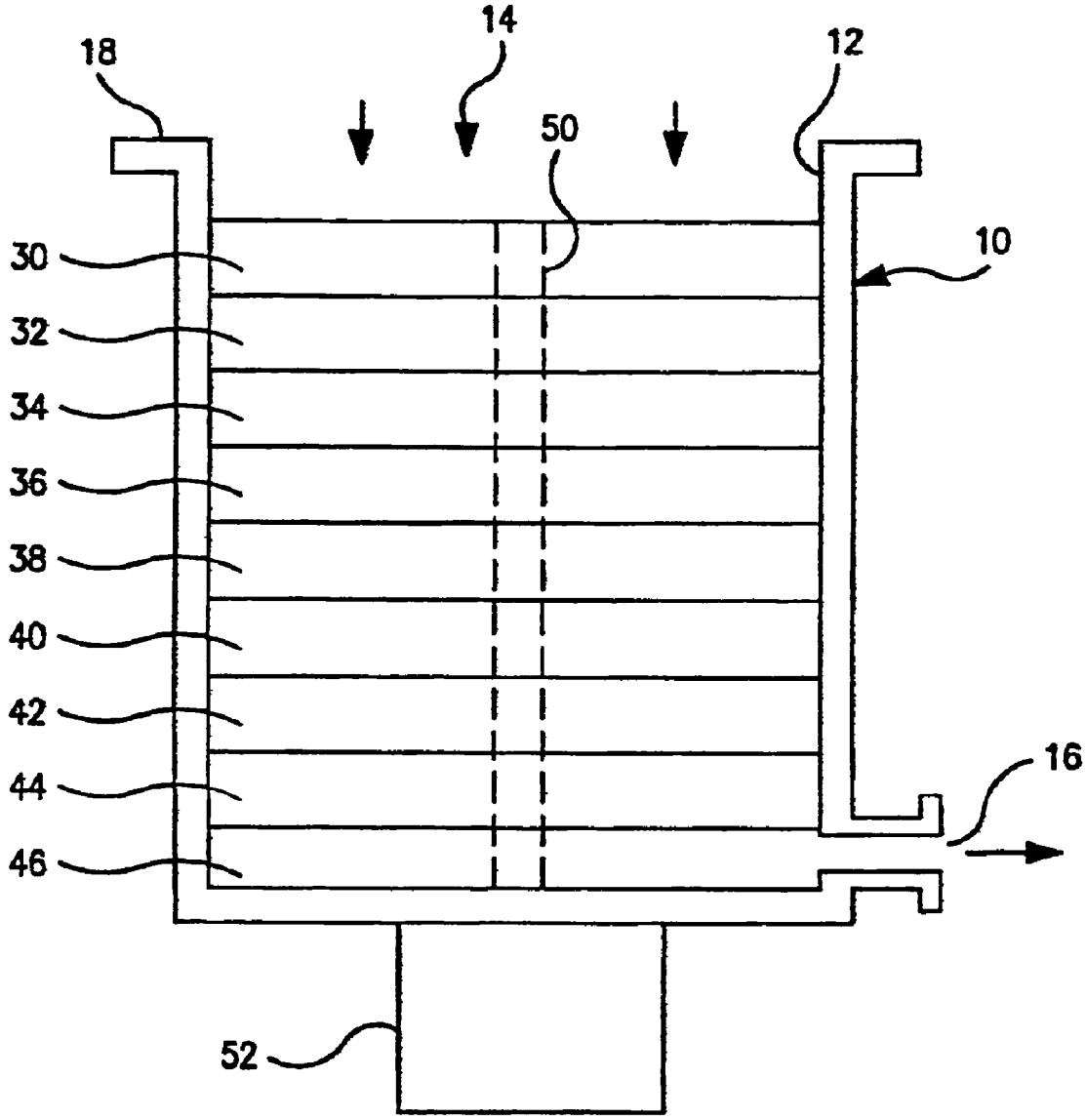
FIG. 1 is a simplified cross-sectional schematic diagram of a vacuum pump in accordance with an embodiment of the invention.

A simplified cross-sectional diagram of a high vacuum pump in accordance with an embodiment of the invention is shown in FIG. 1. A housing 10 defines an interior chamber 12 having an inlet port 14 and an exhaust port 16. The housing 10 includes a vacuum flange 18 for sealing the inlet port 14 to a vacuum chamber (not shown) to be evacuated. The exhaust port 16 may be connected to a roughing vacuum pump (not shown). In cases where the vacuum pump is capable of exhausting to atmospheric pressure, the roughing pump is not required.

Located within housing 10 are vacuum pumping stages 30, 32, . . . , 46. Each vacuum pumping stage includes a stationary member, or stator, and a rotating member, also known as an impeller or a rotor. The rotating member of each vacuum pumping stage is coupled by a drive shaft 50 to a motor 52. The shaft 50 is rotated at high speed by motor 52, causing rotation of the rotating members about a central axis and pumping of gas from inlet port 14 to exhaust port 16. The embodiment of FIG. 1 has nine stages. It will be understood that a different number of stages can be utilized, depending on the vacuum pumping requirements.

The vacuum pumping stages 30, 32, . . . , 46 are configured for efficient operation within a specified pressure range. By way of example, the pressure at inlet port 14 during operation may be on the order of $10^{-5}$ to $10^{-6}$ torr, whereas the pressure at exhaust port 16 may be at or near atmospheric pressure. The pressure through the vacuum pump gradually increases from inlet port 14 to exhaust port 16. The characteristics of each vacuum pumping stage may be selected for efficient operation over an expected operating pressure range of that stage.

Figure 2:
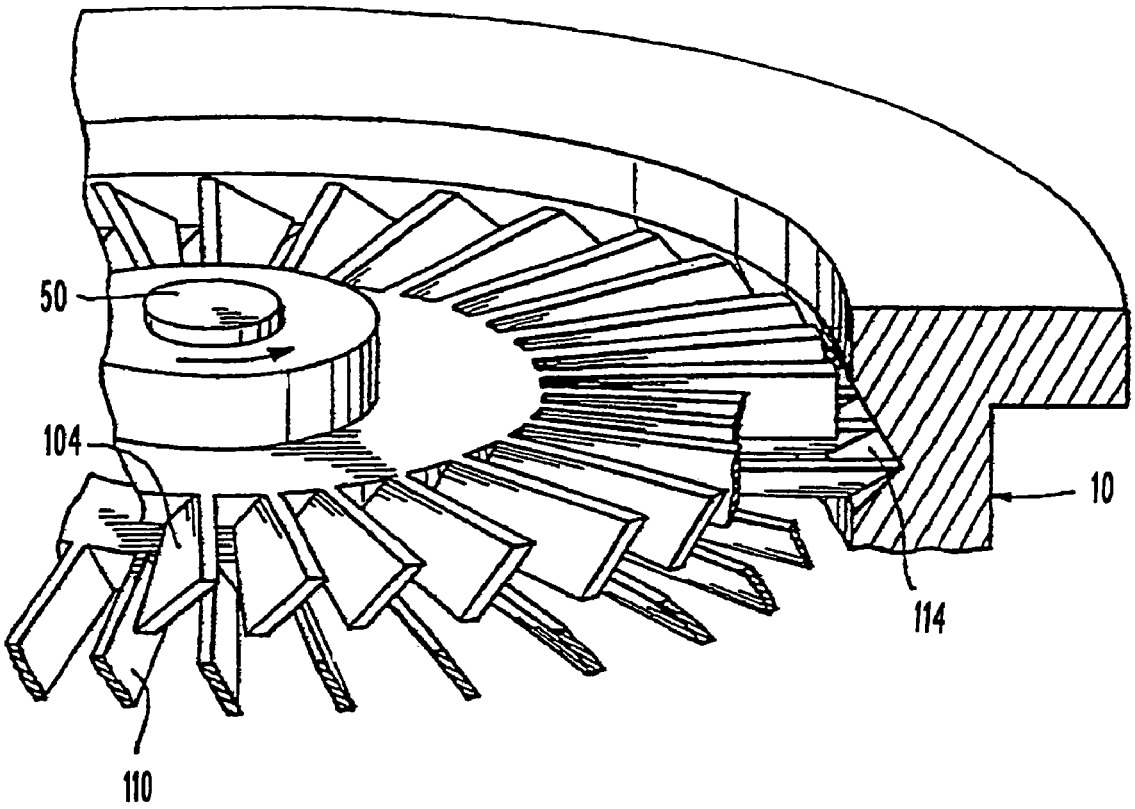
FIG. 2 is a fragmentary perspective view of an axial flow stage that may be utilized in the vacuum pump of FIG. 1.

In one embodiment, vacuum pumping stages 30, 32, 34 and 36 may be axial flow stages, as shown in FIG. 2 and described below. Vacuum pumping stages 38, 40 and 42 may be modified molecular drag stages, as described below in connection with FIGS. 6A-8B and 10A-10C. As used herein, "modified molecular drag stage" refers to a vacuum pumping stage which includes a rotating disk with a roughened or grooved pumping surface. Modified molecular drag stage excludes molecular drag stages having a rotating cylindrical drum and excludes molecular drag stages having a rotating disk with a flat pumping surface. According to an aspect of the invention, the vacuum pump does not include a molecular drag stage having a rotating cylindrical drum and does not include a molecular drag stage having a rotating disk with a flat pumping surface. Modified molecular drag stages 38, 40 and 42 may have impellers which are configured for operation at successively higher pressures, as described below. Vacuum pumping stages 44 and 46 may be regenerative vacuum pumping stages, as described below in connection with FIGS. 3-5, 9A and 9B.

The vacuum pump includes one or more axial flow stages and one or more additional stages. The additional stages may include modified molecular drag stages, regenerative stages, or both. The total number of stages in the vacuum pump may be varied within the scope of the invention. Furthermore, the number of axial flow stages and the number of additional vacuum pumping stages may be varied within the scope of the invention.

An embodiment of an axial flow stage is shown in FIG. 2. Pump housing 10 has inlet port 14. The axial flow stage includes a rotor 104 and a stator 110. The rotor 104 is connected to shaft 50 for high speed rotation about the central axis. The stator 110 is mounted in a fixed position relative to housing 10. The rotor 104 and the stator 110 each have multiple inclined blades. The blades of rotor 104 are inclined in an opposite direction from the blades of stator 110. Variations of conventional axial flow stages are disclosed in the aforementioned Patent No. 5,358,373, which is hereby incorporated by reference.

The axial flow stages in the vacuum pump of FIG. 1 may have different rotor and stator configurations which are optimized for operation at different pressure levels. In particular, angles of the inclined blades of the stator and the rotor may be varied in different stages of the vacuum pump. In one example, first stage 30 may have rotor and stator blades inclined at 45 degrees; second stage 32 may have rotor blades inclined at 30 degrees and stator blades inclined at 20 degrees; third stage 34 may have rotor blades inclined at 20 degrees and stator blades inclined at 10 degrees; and fourth stage 36 may have rotor blades inclined at 10 degrees and stator blades inclined at five degrees. It will be understood that these blade angles are given by way of example only and are not limiting as to the scope of the invention.

Figure 3:
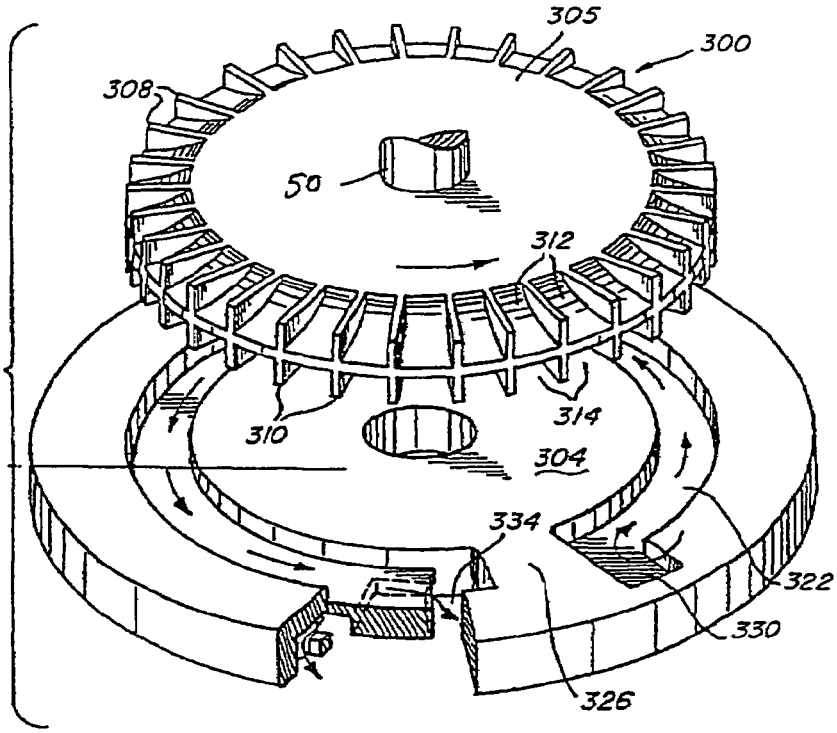
FIG.3 PRIOR ART
FIG. 3 is an exploded perspective view of a regenerative vacuum pumping stage, showing a regenerative impeller and a lower stator portion.
Figure 4:
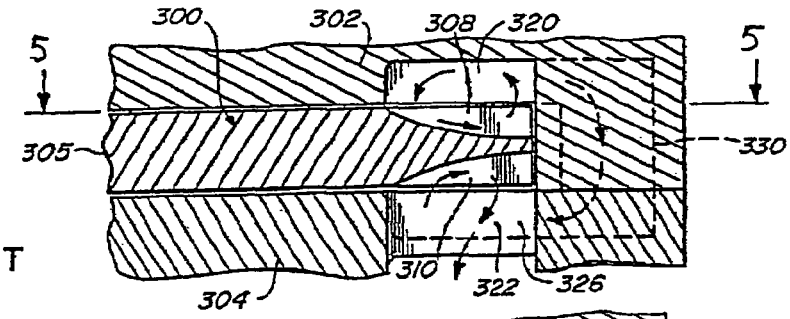
FIG.4 PRIOR ART
FIG. 4 is a partial cross-sectional view of the regenerative vacuum pumping stage of FIG. 3.
Figure 5:
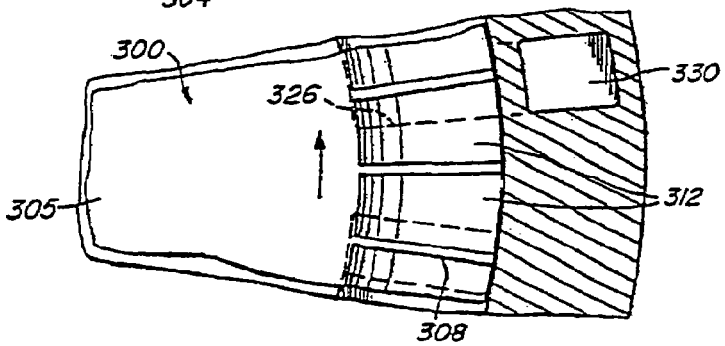
FIG.5 PRIOR ART
FIG. 5 is a partial plan view of the regenerative vacuum pumping stage, taken along the line 5-5 of FIG. 4.

An example of a regenerative vacuum pumping stage is shown in FIGS. 3-5. The regenerative vacuum pumping stage includes a regenerative impeller 300 which operates with a stator having an upper stator portion 302 adjacent to an upper surface of regenerative impeller 300, and a lower stator portion 304 adjacent to the lower surface of regenerative impeller 300. The upper stator portion 302 is omitted from FIG. 3 for clarity. The regenerative impeller 300 comprises a disk 305 having spaced-apart radial ribs 308 on its upper surface and spaced-apart radial ribs 310 on its lower surface. The ribs 308 and 310 are preferably located at or near the outer periphery of disk 305. Cavities 312 are defined between each pair of ribs 308, and cavities 314 are defined between each pair of ribs 310. In the embodiment of FIGS. 3-5, the cavities 312 and 314 have curved contours formed by removing material of the disk 305 between ribs 308 and between ribs 310. The cross-sectional shape of the cavities 312 and 314 can be rectangular, triangular, or any other suitable shape. The disk 305 is attached to shaft 50 for high speed rotation around the central axis of the vacuum pump.

The upper stator portion 302 has a circular upper channel 320 formed in opposed relationship to ribs 308 and cavities 312. The lower stator portion 304 has a circular lower channel 322 formed in opposed relationship to ribs 310 and cavities 314. The upper stator portion 302 further includes a blockage (not shown) of channel 320 at one circumferential location. The lower stator portion 304 includes a blockage 326 of channel 322 at one circumferential location. The stator portions 302 and 304 define a conduit 330 adjacent to blockage 326 that interconnects upper channel 320 and lower channel 322 around the edge of disk 305. Upper channel 320 receives gas from a previous stage through a conduit (not shown). The lower channel 322 discharges gas to a next stage through a conduit 334.

In operation, disk 305 is rotated at high speed about shaft 50. Gas entering upper channel 320 from the previous stage is pumped through upper channel 320. The rotation of disk 305 and ribs 308 causes the gas to be pumped along a roughly helical path through cavities 312 and upper channel 320. The gas then passes through conduit 330 into lower channel 322 and is pumped through channel 322 by the rotation of disk 305 and ribs 310. In the same manner, the ribs 310 cause the gas to be pumped in a roughly helical path through cavities 314 and lower channel 322. The gas is then discharged to the next stage through conduit 334.

It will be understood that the size, shape and spacing of ribs 308 and 310, and the size and shape of the corresponding cavities 312 and 314 can be varied. Furthermore, channels 320 and 322 may be connected in series or in parallel. Different configurations of regenerative vacuum pumping stages are disclosed in the aforementioned U.S. Pat. No. 5,358,373.

The modified molecular drag stages in the vacuum pump of FIG. 1 may have different impeller configurations which are optimized for operation at different pressure levels. Each impeller is generally disk-shaped and has at least one pumping surface at or near its outer periphery. Typically, the pumping surface is an annular region on the front surface, the rear surface, or both, of the disk-shaped impeller. In addition, the pumping surface may include the outer edge that joins the front and rear surfaces.

Figure 6A:
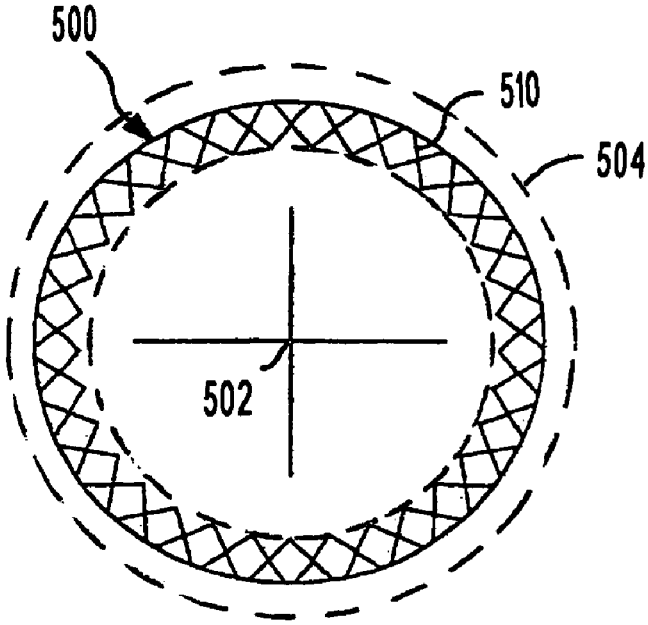
FIGS. 6A and 6B are plan and side views, respectively, of a modified molecular drag impeller having a roughened pumping surface.
Figure 6B:
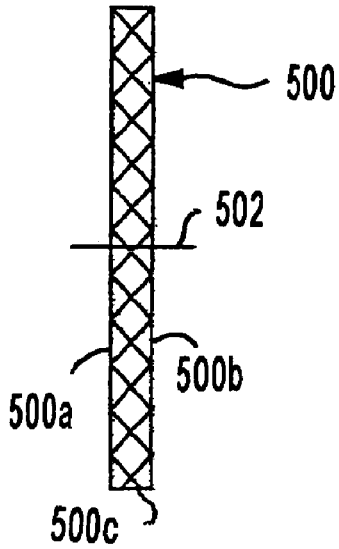

Referring to FIGS. 6A and 6B, a disk-shaped impeller 500 for a modified molecular drag stage is shown. Impeller 500 rotates at high speed about an axis 502 during operation. A stator having a pumping channel 504, indicated by dashed lines in FIG. 6A, is positioned in close proximity to impeller 500. Pumping channel 504 is typically located at or near an outer periphery of impeller 500. A portion of impeller 500 facing pumping channel 504 functions as a vacuum pumping surface 510. Thus, vacuum pumping surface 510 is the portion of impeller 500 that is exposed to pumping channel 504. The vacuum pumping surface 510 is typically an annular area of impeller 500 at or near its outer periphery. Vacuum pumping surface 510 may be located on a front surface 500*a*, a rear surface 500*b*, or both, of impeller 500. In addition, vacuum pumping surface 510 may be located on an outer edge 500*c* of disk-shaped impeller 500. The impeller 500 may include two or more concentric vacuum pumping surfaces on front surface 500*a*, rear surface 500*b*, or both, depending on the stator configuration.

Impeller 500 may be utilized in vacuum pumping stage 38 of vacuum pump 10. Impeller 500 has a roughened vacuum pumping surface 510. The surface roughness depends on the expected operating pressure range and should be sufficient to induce into the drag mechanism a relatively thick layer adjacent to the impeller surface.

Figure 7A:
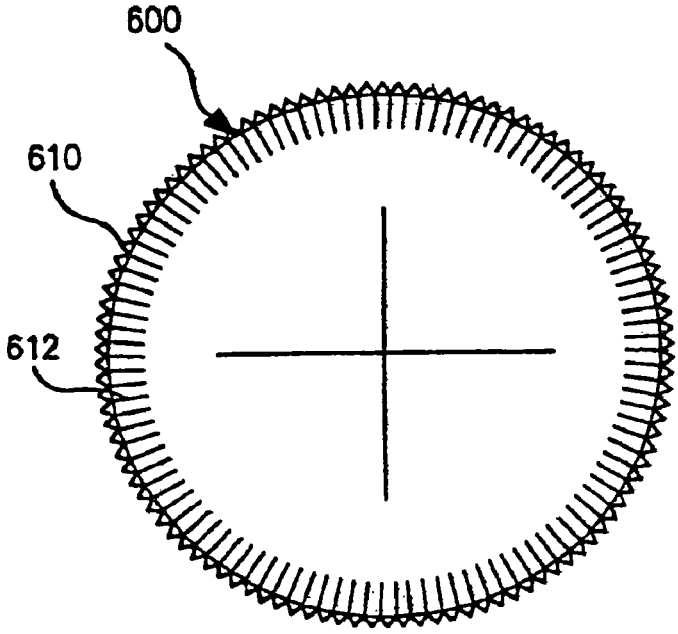
FIGS. 7A and 7B are plan and side views, respectively, of a modified molecular drag impeller having a pumping surface provided with relatively shallow grooves.
Figure 7B:
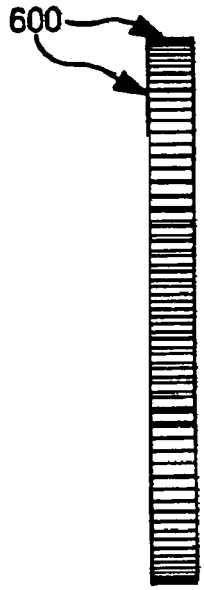

Referring to FIGS. 7A and 7B, an impeller 600 may be utilized in vacuum pumping stage 40 of vacuum pump 10. A vacuum pumping surface 610 of impeller 600 is configured for operation at higher pressures than impeller 500 of FIGS. 6A and 6B and may have a series of radial grooves in vacuum pumping surface 610. The spacing and depth of the grooves depend on the expected operating pressure range. Preferably, the grooves 612 may have depths in a range of about 1 to 2 millimeters in mid-sized pumps. In other embodiments for operation in the same pressure range, the vacuum pumping surface 610 may have increased surface roughness in comparison with impeller 500 or may have any surface topography that produces efficient operation in the expected pressure range.

Figure 8A:
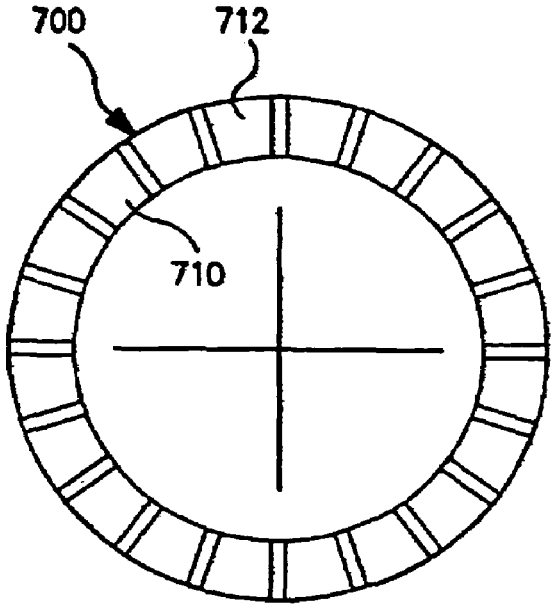
FIGS. 8A and 8B are plan and side views, respectively, of a modified molecular drag impeller having a pumping surface provided with relatively deep grooves.
Figure 8B:
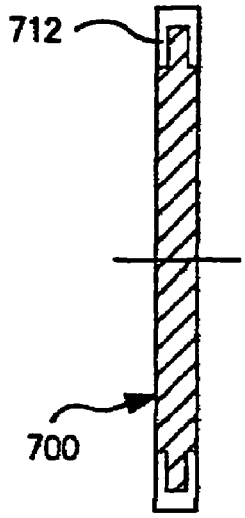

Referring to FIGS. 8A and 8B, an impeller 700 may be utilized in vacuum pumping stage 42 of vacuum pump 10. Impeller 700 has a vacuum pumping surface 710 that is configured for operation at higher pressures than impeller 600 of FIGS. 7A and 7B. Vacuum pumping surface 710 of impeller 700 may have grooves 712 that are deeper and/or more closely spaced than the grooves 612 on impeller 600. Alternatively, vacuum pumping surface 710 may have another surface topography that is selected for efficient operation in the expected operating pressure range.

Figure 9A:
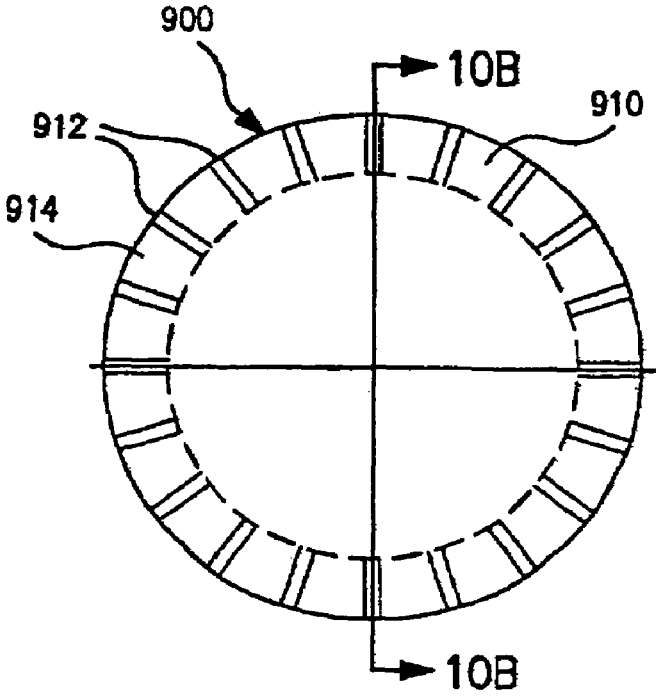
FIGS. 9A and 9B are plan and cross-sectional views, respectively, of an impeller for a regenerative vacuum pumping stage.
Figure 9B:
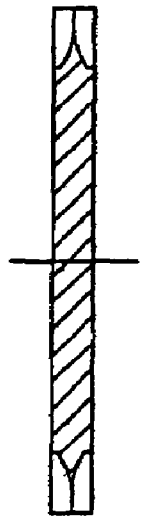

Referring to FIGS. 9A and 9B, a regenerative impeller 900 may be utilized in vacuum pumping stages 44 and 46 of vacuum pump 10. Impeller 900 includes a vacuum pumping surface 910 having a series of spaced-apart radial ribs 912 which define cavities 914. The size and shape of the ribs 912 and the corresponding cavities 914 are selected for efficient vacuum pumping over the expected operating pressure range. For example, the radial extent of ribs 912 may be varied. The regenerative impellers in vacuum pumping stages 44 and 46 may be configured for efficient operation over different pressure ranges. In some embodiments, vacuum pump 10 may include a single regenerative vacuum pumping stage or more than two regenerative vacuum pumping stages having impellers which are configured for operation at progressively higher pressures. The configurations of the ribs and the cavities may be selected for efficient operation in the expected operating pressure range. In other embodiments, two or more regenerative vacuum pumping stages may utilize the same impeller configuration.

Together, impellers 500, 600, 700 and 900 shown in FIGS. 6A and 6B, 7A and 7B, 8A and 8B, and 9A and 9B, respectively, constitute a set of impellers having graduated characteristics for efficient operation at progressively higher pressures. Thus, one or more impellers may have characteristics selected for efficient operation under molecular flow conditions, one or more impellers may have characteristics selected for efficient operation under transition flow conditions and one or more impellers may have characteristics selected for efficient operation under viscous flow conditions, with the impellers in the set having a gradual change in pumping characteristics. Each impeller has a vacuum pumping surface with a surface topography that is configured for efficient operation over an expected pressure range. While the impellers in the set have a gradual change in pumping characteristics, this does preclude two or more impellers being the same. As noted above, the vacuum pumping surface of each impeller may include all or part of the front surface, all or part of the rear surface and/or all or part of the outer edge in any combination.

Figure 10A:
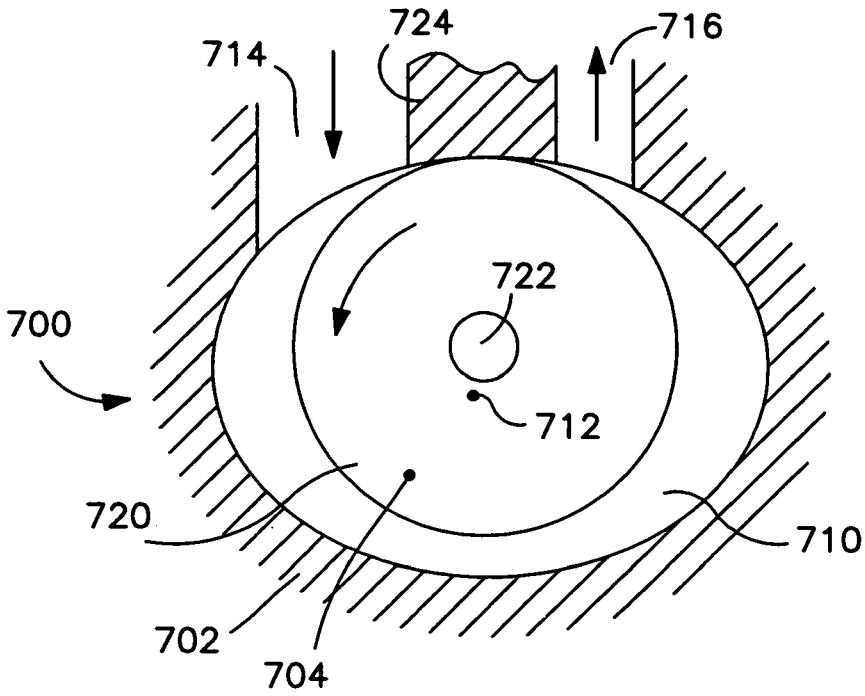
FIGS. 10A and 10B are plan and partial cross-sectional views, respectively, of a modified molecular drag stage having an offset impeller.
Figure 10B:
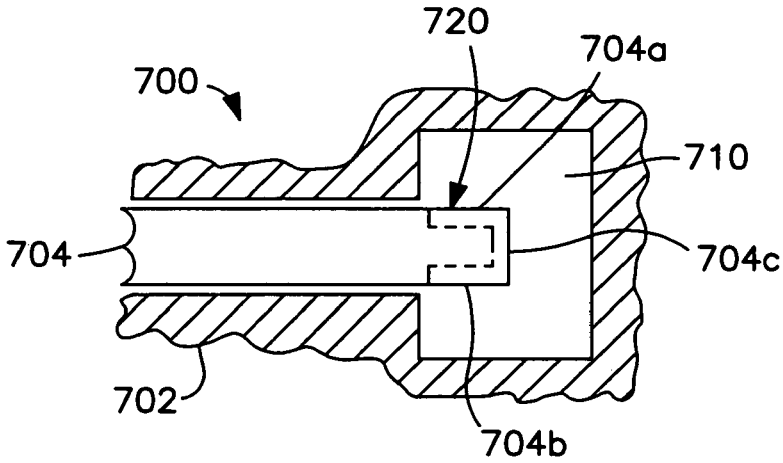

A further embodiment of a modified molecular drag stage is shown in FIGS. 10A and 10B. A modified molecular drag stage 700 includes a stator 702 and an impeller 704. The stator 702 defines a pumping channel 710, an inlet 714, and an outlet 716. An outer periphery of pumping channel 710 may be circular and may have a center 712. Impeller 704 includes a pumping surface 720, which may be roughened or grooved as described above, at or near its outer periphery. Impeller 704 rotates about an axis 722. As shown in FIG. 10B, pumping surface 720 may be located on a front surface 704*a*, a rear surface 704*b* and an outer edge 704*c* of impeller 704.

In the embodiment of FIG. 10A, axis 722 of impeller 704 is displaced from center 712 of stator 702, so that a portion of impeller 704 is in close proximity to a stator portion 724 between inlet 714 and outlet 716. Stator portion 724 serves as a baffle, or stripper.

Figure 10C:
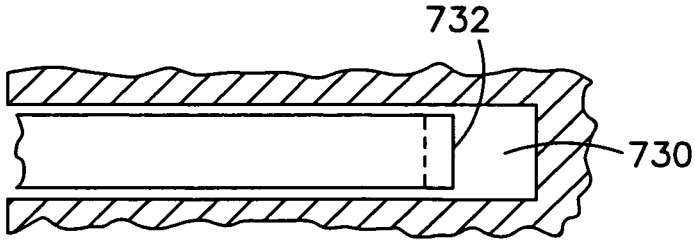
FIG. 10C is a partial cross-sectional view of the modified molecular drag stage of FIG. 10A, showing an alternate configuration.

An alternate configuration of the modified molecular drag stage of FIG. 10A is shown in FIG. 10C. In the configuration of FIG. 10C, stator 702 defines a pumping channel 730 at the outer periphery of impeller 704, but does not have pumping channels at the front and rear surfaces of impeller 704. Impeller 704 has a pumping surface 732 on its outer edge that may be roughened or grooved as described above.

It should be understood that various changes and modifications of the embodiments shown in the drawings described in the specification may be made within the spirit and scope of the present invention. Accordingly, it is intended that all matter contained in the above description and shown in the accompanying drawings be interpreted in an illustrative and not in a limiting sense. The invention is limited only as defined in the following claims and the equivalents thereto.

What is claimed is:

1. A vacuum pump comprising:

a housing having an inlet port and an exhaust port;

one or more axial flow stages located within said housing, each of the axial flow stages including a stator and an impeller, each having inclined blades;

at least one additional vacuum pumping stage which is not an axial flow stage, said additional vacuum pumping stage being located within said housing and including a stator and an impeller, wherein an axis of rotation of the additional vacuum pumping stage is offset from a center of the stator of the additional vacuum pumping stage; and a motor to rotate said impellers such that gas is pumped from said inlet port to said exhaust port.

2. The vacuum pump as defined in claim 1, the additional vacuum pumping stage comprises a modified molecular drag stage wherein the impeller includes a disk having a roughened pumping surface.

3. The vacuum pump as defined in claim 1, the additional vacuum pumping stage comprises a modified molecular drag stage wherein the impeller includes a disk having a grooved pumping surface.

4. The-vacuum pump as defined in claim 1, the additional vacuum pumping stage comprises a regenerative stage.

5. The vacuum pump as defined in claim 1, wherein the additional vacuum pumping stage includes two or more additional vacuum pumping stages.

6. The vacuum pump as defined in claim 5, wherein the two or more additional vacuum pumping stages include a modified molecular drag stage and a regenerative stage, wherein the impeller of the modified molecular drag stage comprises a disk having a roughened or grooved pumping surface.

7. The vacuum pump as defined in claim 5, wherein the impellers of successive ones of the additional vacuum pumping stages are configured for operation at progressively higher pressures.

8. The vacuum pump as defined in claim 5, wherein the two or more additional vacuum pumping stages comprise regenerative stages.

9. The vacuum pump as defined in claim 1 or 4, wherein the inclined blades of successive ones of the axial flow stages have progressively smaller angles.

10. A vacuum pump comprising:

a housing having an inlet port and an exhaust port;

one or more axial flow stages located within said housing, each of the axial flow stages including a stator and an impeller, each having inclined blades;

at least one modified molecular drag stage located within said housing and including a stator and an impeller, wherein an axis of rotation of the modified molecular drag stage is offset from a center of the stator of the additional vacuum pumping stage; and a motor, which rotates said impellers such that gas is pumped from said inlet port to said exhaust port.

11. The vacuum pump as defined in claim 10, wherein the impeller of the modified molecular drag stage comprises a disk having a roughened pumping surface.

12. The vacuum pump as defined in claim 10, wherein the impeller of the modified molecular drag stage comprises a disk having a grooved pumping surface.

13. The vacuum pump as defined in claim 10, wherein the at least one modified molecular drag stage comprises two or more modified molecular drag stages.

14. A vacuum pump comprising:

a housing having an inlet port and an exhaust port;

one or more axial flow stages located within said housing, each of the axial flow stages including a stator and an impeller, each having inclined blades;

at least one regenerative pumping stage located within said housing and including a stator and an impeller, wherein an axis of rotation of the at least one regenerative stage is offset from a center of the stator of the regenerative pumping stage; and a motor, which rotates said impellers such that gas is pumped from said inlet port to said exhaust port, wherein the vacuum pump does not include a molecular drag stage having a rotating cylindrical drum or a rotating disk with a flat pumping surface.

15. The vacuum pump as defined in claim 14, wherein the at least one regenerative stage comprises two or more regenerative stages.

* * * * *